US011239556B2

(12) United States Patent
Martel

(10) Patent No.: US 11,239,556 B2
(45) Date of Patent: Feb. 1, 2022

(54) MULTI-BAND ANTENNA

(71) Applicants: Office National d'Etudes et de Recherches Aérospatiales, Palaiseau (FR); AIRBUS OPERATIONS (S.A.S.), Toulouse (FR)

(72) Inventor: Cédric Martel, Pechabou (FR)

(73) Assignees: OFFICE NATIONAL D'ETUDES ET DE RECHERCHES AEROSPATIALES, Palaiseau (FR); AIRBUS OPERATIONS (S.A.S.), Toulouse (FR)

( * ) Notice: Subject to any disclaimer, the term of this patent is extended or adjusted under 35 U.S.C. 154(b) by 0 days.

(21) Appl. No.: 17/032,928

(22) Filed: Sep. 25, 2020

(65) Prior Publication Data

US 2021/0098877 A1 Apr. 1, 2021

(30) Foreign Application Priority Data

Sep. 27, 2019 (FR) ..... 19 10719

(51) Int. Cl.

| | |
|---|---|
| ***H01Q 5/15*** | (2015.01) |
| ***H01Q 5/357*** | (2015.01) |
| ***H01Q 1/28*** | (2006.01) |
| *H01Q 1/38* | (2006.01) |

(52) U.S. Cl.

CPC ..... *H01Q 5/15* (2015.01); *H01Q 1/28* (2013.01); *H01Q 5/357* (2015.01)

(58) Field of Classification Search

CPC ..... H01Q 5/15; H01Q 5/357; H01Q 1/28; H01Q 1/38; H01Q 21/30; H01Q 9/0421; H01Q 9/0414

See application file for complete search history.

(56) References Cited

U.S. PATENT DOCUMENTS

| | | | | |
|---|---|---|---|---|
| 4,827,271 | A * | 5/1989 | Berneking | H01Q 9/0414 343/700 MS |
| 5,767,810 | A * | 6/1998 | Hagiwara | H01Q 9/0421 343/700 MS |
| 6,118,406 | A | 9/2000 | Josypenko | |
| 6,750,825 | B1 | 1/2004 | Delaveaud et al. | |
| 2003/0146872 | A1 * | 8/2003 | Kellerman | H01Q 5/385 343/700 MS |
| 2014/0197994 | A1 | 7/2014 | Hossain | |

FOREIGN PATENT DOCUMENTS

| | | |
|---|---|---|
| FR | 2 709 878 | 3/1995 |

OTHER PUBLICATIONS

Search Report for FR1910719.

(Continued)

*Primary Examiner* — Hoang V Nguyen

(74) *Attorney, Agent, or Firm* — Nixon & Vanderhye P.C.

(57) ABSTRACT

A multi-band antenna (100) including a metal base plate (10) forming an electrical ground plane, and a plurality of metal patches (1 to 3) superimposed on top of the metal base plate. The metal patches are connected in parallel between a signal lead wire (11A) and the metal base plate. The metal patches have respective surface areas which increase with the distance of each metal patch from the metal base plate. The antenna provides as many different resonant frequency values as there are patches.

18 Claims, 5 Drawing Sheets

(56) References Cited

OTHER PUBLICATIONS

Chamaani, "Miniaturized Dual-Band Omnidirectional Antenna for Body Area Network Basestations", IEEE Antennas and Wireless Propagation Letters, vol. 14, Apr. 7, 2015, pp. 1722-1725.
Delaveaud et al., "New Kind of Microstrip Antenna: The Monopolar Wire-Patch Antenna", Electronics Letters, Jan. 6, 1994, vol. 30, No. 1, pp. 1-2.

* cited by examiner

MULTI-BAND ANTENNA

RELATED APPLICATION

This application claims priority to French Patent Application 19 10719, filed Sep. 27, 2019, the entirety of which is incorporated by reference.

TECHNICAL FIELD

This description concerns a multi-band antenna as well as a method for manufacturing such an antenna. The antenna described is particularly suitable for installation on an aircraft.

BACKGROUND

Many applications require the use of multi-band antennas, particularly data communication between an airplane and the ground infrastructure of an airport. Such a communication link can in particular enable the transmission of data from the airplane when it is located near the airport or parked at its boarding gate, to an operator of the commercial line served by the airplane or to an aircraft maintenance operator. The Gatelink system, for example, provides a high speed wireless communication protocol for such an application. However, when the antenna is attached to the airplane fuselage, it forms a barrier to the optimal flow of outside air along the airplane fuselage.

The article which is entitled "New kind of microstrip antenna: the monopolar wire-patch antenna", by C. Delaveaud, P. Leveque and B. Jecko, Electronics Letters, Jan. 6, 1994, Vol. 30 (1), describes an antenna constituted by a metal base plate which serves as an electrical ground plane, and by a metal patch which is parallel to the metal base plate and distanced from it. The metal patch is electrically connected to a signal lead wire, and is electrically connected to the metal base plate by electrical circuit closure connections. Such an antenna, of the shorted capacitive roof type, is single-band with a single resonant frequency value which is determined by the surface area of the metal patch and the length of the electrical circuit closure connections. Its radiation pattern is monopolar, with a polarization of the far-field electrical field that is essentially linear and oriented perpendicularly to the metal base plate.

In addition, document FR 2 709 878 discloses the addition of a second metal patch to such an antenna with shorted capacitive roof, smaller than and parallel to the previous one, on a side of the first patch which is opposite to the metal base plate. The second patch is electrically connected only to the first patch, independently of the signal lead wire, the metal base plate, and the electrical circuit closure connections of the first patch. Such an antenna is then dual-band, with two different resonant frequency values. But the second patch increases the total thickness of the dual-band antenna compared to the single-band antenna with shorted capacitive roof which only has the first metal patch.

SUMMARY OF INVENTION

The present invention may be embodied to provide improved multi-band antennas which are thin and inexpensive, and whose geometric characteristics can be determined by digital simulations based on desired values for the resonant frequencies.

A first embodiment of the invention is a multi-band antenna which comprises: a metal base plate, which is intended to serve as an electrical ground plane; and a plurality of metal patches, which are parallel to the metal base plate and which are each arranged at a different respective distance from this metal base plate.

According to one feature of the invention, the metal patches are each electrically connected to one and same signal lead wire, which is shared by the metal patches, and each metal patch is furthermore connected to the metal base plate independently of the other metal patches, by at least one electrical circuit closure connection which is dedicated to that metal patch. Thus, all the metal patches are connected in parallel between the signal lead wire and the metal base plate.

According to another feature of the invention, the respective distances of the metal patches to the metal base plate and respective surface area values of the metal patches are such that each metal patch with said at least one electrical circuit closure connection dedicated to that metal patch constitutes a radiating element which has at least one resonant frequency value which is different from that of each other radiating element. The antenna is thus multi-band.

Such an antenna can be produced by simple and inexpensive manufacturing techniques, in particular by printed circuit board technology, or PCB. Furthermore, by selecting an appropriate size for each metal patch, the antenna can have a reduced total thickness perpendicular to the metal base plate. With such a reduced thickness, the antenna can be attached to the fuselage of an aircraft without significantly interfering with airflow along the fuselage of the aircraft.

In embodiments of the invention, the metal patches may be superimposed in a direction of superposition which is perpendicular to the metal base plate, and each metal patch may have a surface area value which is different from that of each other metal patch. This patch surface area value may increase between two different metal patches as a function of the distance of each metal patch from the metal base plate. For such a configuration, the metal patch that is farthest from the metal base plate, with its electrical circuit closure connection(s), produces the lowest resonant frequency value, and each additional patch produces an additional resonant frequency value which is increasingly higher for patches which are smaller and closer to the metal base plate.

In various embodiments of the invention, at least one of the following additional features may optionally be reproduced, alone or in combination:

each metal plate may have any shape. For example, at least one metal plate may have a disk shape, or square, or any other appropriate shape;

each electrical circuit closure connection may be a conductive wire, a metal contact stud, or a conductive tab;

each metal patch may be connected to the signal lead wire at a central point of that metal patch;

several electrical circuit closure connections may be dedicated to a same one of the metal patches, and these electrical circuit closure connections dedicated to a same metal patch may be in an arrangement which is symmetrical relative to a connection point of that metal patch to the signal lead wire;

each electrical circuit closure connection dedicated to one of the metal patches may be connected to a peripheral edge of this metal patch;

each metal patch may be connected to the metal base plate by any number of electrical circuit closure connections, such as less than or equal to twelve, for example by two or four electrical circuit closure connections;

the metal patches may be superimposed in a direction of superposition which is perpendicular to the metal base plate, and a separation gap between two successive metal patches in this direction of superposition is a gap of air or of solid electrically insulating material; and separation gaps between pairs of successive metal patches in the direction of superposition may be of thicknesses that are identical between different pairs and identical to the thickness of a separation gap which exists between the metal base plate and the metal patch which is closest to the metal base plate.

A second aspect of the invention proposes an aircraft, for example an airplane, which comprises a multi-band antenna according to the first aspect, attached to a fuselage of the aircraft.

Finally, a third aspect of the invention relates to a method for manufacturing a multi-band antenna in accordance with the first aspect, this method comprising the sequence of the following steps (1) to (4):

(1) for the one of the metal patches which is farthest from the metal base plate, referred to as the first metal patch, determining a surface area value of this first metal patch and a spacing distance value between this first metal patch and the metal base plate such that a first elementary antenna, of shorted capacitive roof type, which is formed by the first metal patch with the at least one electrical circuit closure connection dedicated to this first metal patch, and with the metal base plate and the signal lead wire, has a first resonant frequency target value and a first spectral width of resonance;

(2) for a second of the metal patches, which comes after the first metal patch in the direction of superposition moving towards the metal base plate, setting a spacing distance between the second metal patch and the metal base plate to a value which is less than that of the spacing distance between the first metal patch and the metal base plate, then determining a surface area value of the second metal patch such that a second elementary antenna, of shorted capacitive roof type, which is formed by the second metal patch with the at least one electrical circuit closure connection dedicated to this second metal patch, and with the metal base plate and the signal lead wire, has a second resonant frequency target value and a second spectral width of resonance;

(3) adjusting the value of the spacing distance between the second metal patch and the metal base plate, and the surface area value of the second metal patch, so that a quotient of the first and second resonant frequency values which are effective when the first and second metal patches are associated together with the metal base plate by the signal lead wire shared by the first and second metal patches, and with the respective electrical circuit closure connections of the first and second metal patches, matches a quotient target value which is equal to a quotient of the second resonant frequency target value over the first resonant frequency target value; and (4) applying a common scale factor to the respective spacing distance values of the first and second metal patches relative to the metal base plate, and to the dimensions of the first and second metal patches which produce their respective surface area values, so that the first resonant frequency value which is effective when the first and second metal patches are associated together with the metal base plate by the signal lead wire shared by the first and second metal patches, and by the respective electrical circuit closure connections of the first and second metal patches, matches the first resonant frequency target value.

The sequence of steps (1) to (4) is then repeated for each pair of neighboring metal patches in the multi-band antenna, shifting by one metal patch in the direction of the metal base plate between two repetitions of the sequence of steps, if the multi-band antenna comprises more than two metal patches.

The method further comprises a step (5) of manufacturing the multi-band antenna in accordance with the values obtained for the spacing distance of each metal patch from the metal base plate, and for the surface area of each metal patch.

An advantage of the method lies in the progressive determination of the respective geometric parameters of the metal patches, given that significant interactions primarily only occur between patches which are neighbors along the direction of superposition. Optionally, the sequence of steps (1) to (4) may be repeated several times for each pair of neighboring metal patches. Also optionally, all the executions of the sequence of steps /1/ to /4/ in order to obtain the values relating to all the patches, may be repeated to achieve a general refinement of the spacing distances and surface area values of the patches.

The first resonant frequency target value may be chosen to be less than the second resonant frequency target value. In this manner, the metal patches can have decreasing surface area values when they are closer to the metal base plate.

For first embodiments of the multi-band antenna, each metal patch may be formed in step (5) in a metallized surface of a respective printed circuit board substrate. Then, segments of the electrical circuit closure connections may be formed through at least some of the printed circuit board substrates. Then the printed circuit board substrates are stacked on the metal base plate so as to establish electrical contact between all segments of a same electrical circuit closure connection, separately for each of the electrical circuit closure connections.

For other embodiments of the multi-band antenna, each metal patch may be formed in step /5/ as a separate metal plate portion, then each separate metal plate portion forming one of the patches can be assembled with the metal base plate using spacers. In this case, the electrical circuit closure connections may possibly form the spacers.

SUMMARY OF THE FIGURES

The features and advantages of the invention will appear more clearly in the following detailed description of some non-limiting embodiments, with reference to the appended figures in which.

DETAILED DESCRIPTION

Figure 1A:
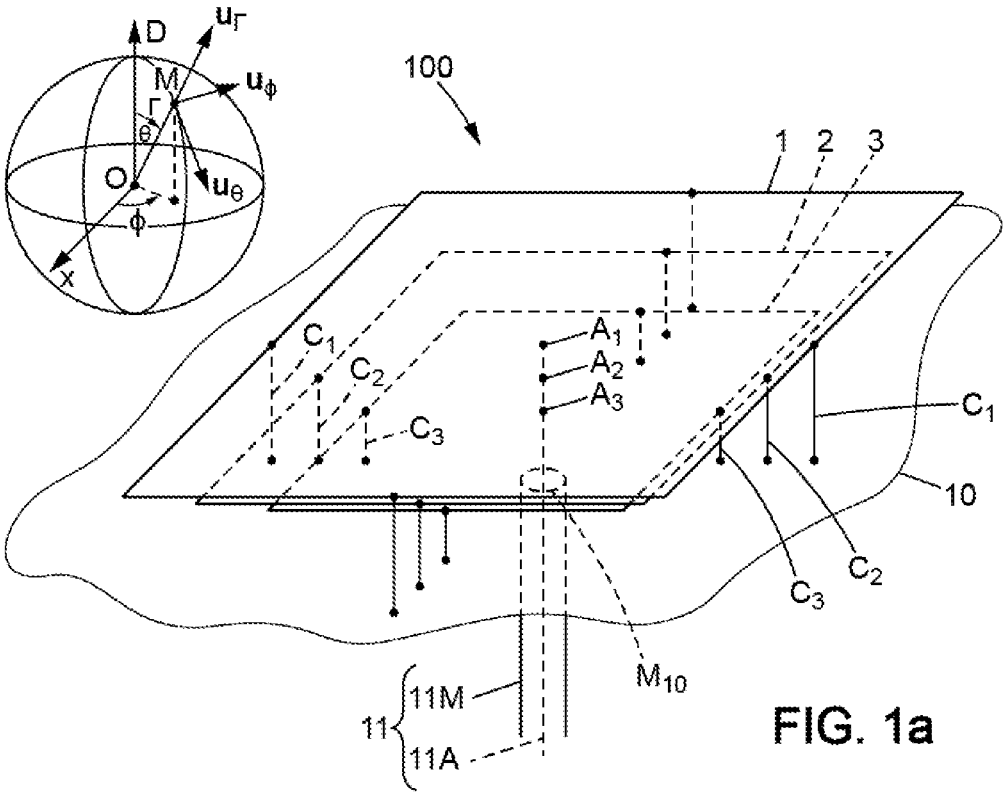
FIG. 1*a* is a perspective view of a multi-band antenna according to an embodiment the invention.
Figure 1B:
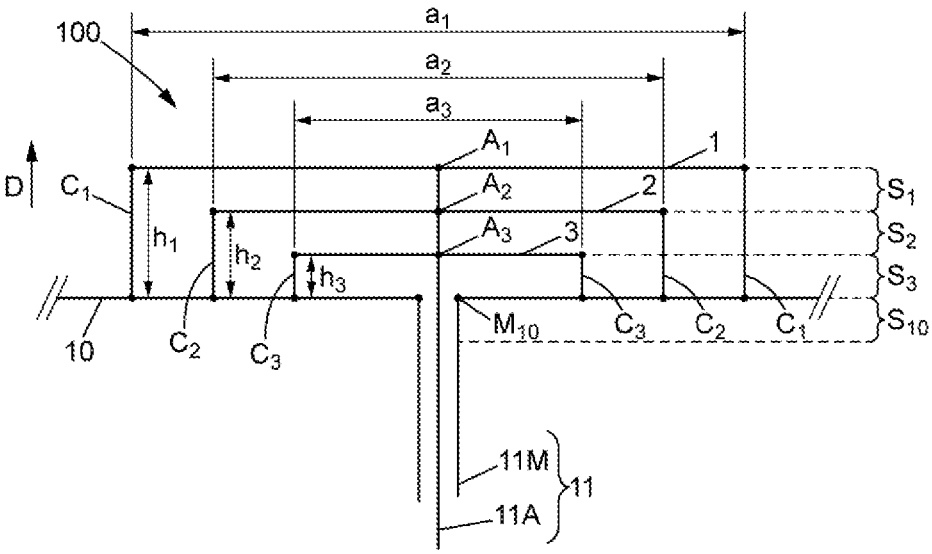
FIG. 1*b* is a sectional view of the multi-band antenna.
Figure 2:
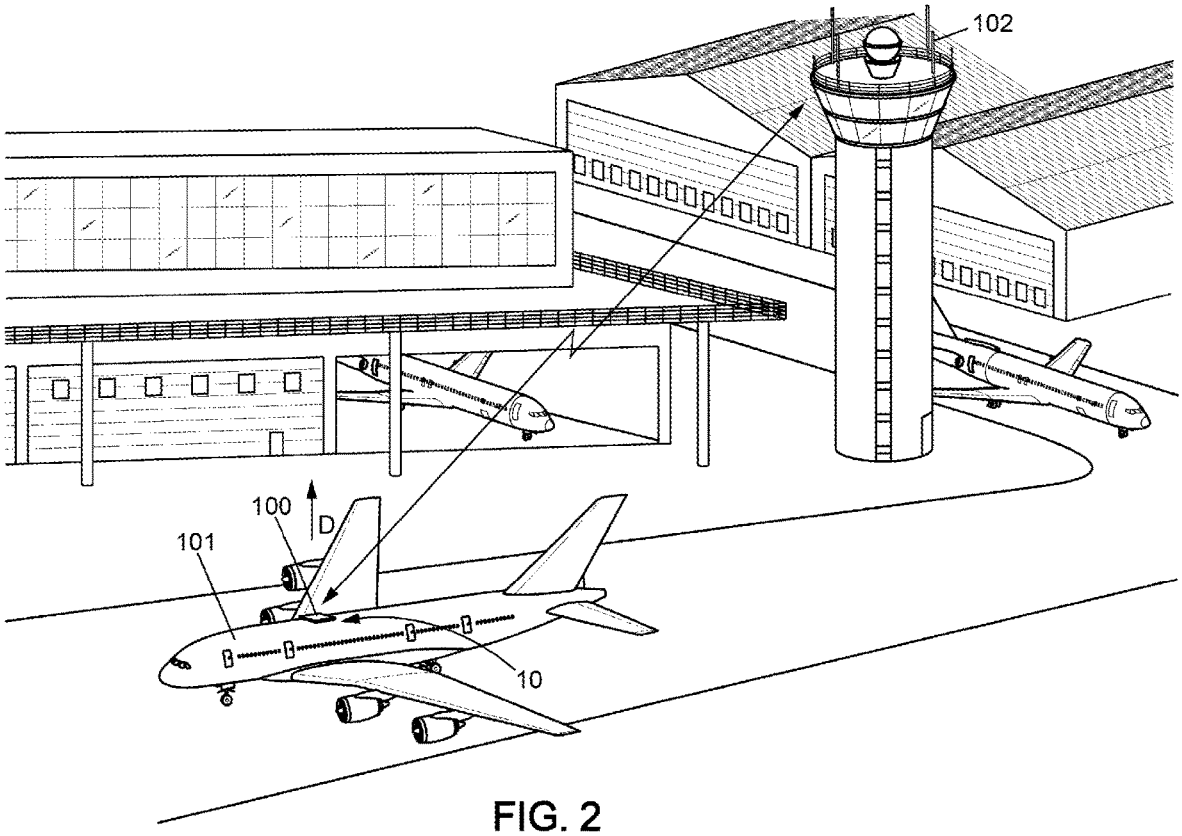
FIG. 2 shows an airplane equipped with the multi-band antenna.

For clarity sake, the dimensions of the elements which are shown in [FIG. 1*a*], [FIG. 1*b*], and [FIG. 2] do not correspond to actual dimensions nor to actual dimension ratios. In addition, identical references indicated in different figures designate elements which are identical or have identical functions.

According to [FIG. 1*a*] and [FIG. 1*b*], a multi-band antenna 100 comprises a metal plate 10, called the metal base plate or base plate, and three metal patches 1, 2 and 3 which are parallel to the base plate 10 and distanced from it by different distances $h_1$, $h_2$ and $h_3$, respectively. The distances $h_1$-$h_3$ are measured in a direction D of superposition of the patches 1-3, which may be perpendicular to the base plate 10. Also, the differences between the distances $h_1$ and $h_2$ on the one hand, and between $h_2$ and $h_3$ on the other hand, may be identical. The base plate 10 is larger, such as having a surface area five to ten times or more, than each of the patches 1-3. In addition, the patches 1-3 have respective surface areas which may increase the further they are from the base plate 10: patch 1 may be larger than patch 2, which in turn is larger than patch 3. Each patch may have any shape, and as an example we can begin by assuming that they are square. $a_i$ then designates the length of each side of patch i. It is understood that the description of an antenna with three patches is only illustrative, and that an antenna according to the invention may have any number of patches greater than or equal to two and may be less than or equal to six. If the patches are too numerous, the radiation emissions by the patches closest to the base plate become highly obscured by the patches further away from the base plate. It is possible for the shapes of all the patches in the antenna to match that of the largest patch but with proportional transformation, with respective scaling ratios which depend on the desired resonant frequencies, as described further below.

For example, each of the patches 1-3 may be made in the form of a portion of metallization layer which is carried by a dielectric substrate, for example by a printed circuit board (PCB). In [FIG. 1*b*], the reference $S_1$ designates a PCB substrate which carries the portion of metallization layer which forms patch 1, the reference $S_2$ designates another PCB substrate which carries the portion of metallization layer which forms patch 2, and the reference $S_3$ designates yet another PCB substrate which carries the portion of metallization layer which forms patch 3. Reference $S_{10}$ may designate yet another PCB substrate which carries a metallization layer which forms the base plate 10, or may designate a portion of a self-supporting metal plate which directly forms the base plate 10. Then, the PCB substrates can be stacked on the base plate 10, with their metallized faces each facing away from the base plate 10. When such PCB technology is used, each electrical connection which connects one of the patches 1-3 to the base plate 10 may be composed of aligned connection segments which are each formed through one of the PCB substrates $S_1$-$S_3$.

According to another possible embodiment for the antenna 100, each of the patches 1-3 may be a respective metal plate portion, and these portions forming the patches of the antenna may be retained above the base plate 10 by suitable spacers, in accordance with the values desired for the distances $h_1$-$h_3$. All the plate portions can thus be separated by air gaps. For such an embodiment, each electrical connection which connects one of the patches 1-3 to the base plate 10 may be composed of a segment of electrical wire, or a conductive column, which is connected by one of its ends to the patch concerned and by the other of its ends to the base plate 10.

[FIG. 2] shows the antenna 100 attached to the fuselage of an airplane 101, with the direction of superposition D which is perpendicular to the outer surface of the fuselage at the location of the antenna 100. It is possible for the base plate 10 to be formed by the fuselage of the airplane 101, when the latter is of metal or has sufficient electrical conduction at the location of the antenna 100. The antenna 100 can then be used for data communications between the airplane 101 and a radio communication antenna 102, in particular to transmit piloting or control data of the airplane according to the Gatelink system.

[FIG. 1*a*] also shows a spherical coordinate system which can be used to specify a point M where radiation emitted by the antenna 100 is received. In the previous example, the point M corresponds to the location of the antenna 102. This reference location is centered at a point O, which may be superimposed on a central point of the antenna 100 or of a part of the antenna. r denotes the distance between points O and M, $\phi$ denotes an azimuth angle within a plane which is coincident with the base plate 10, which can be measured relative to a direction of origin x which is parallel to one of the sides of each of the patches 1-3, and $\theta$ is the elevation angle measured relative to direction D. Under these conditions, the radial unit vector $u_r$ is centrifugal and parallel to direction OM, unit vector $u_\phi$ is perpendicular to the meridian plane which contains point M, and unit vector $u_\theta$ is contained in the meridian plane of point M while being perpendicular to vector $u_r$.

Reference 11 designates a power cable for the antenna 100, for example a coaxial cable whose sheath 11M is connected to the base plate 10, for example in a central region of the plate. Reference $M_{10}$ designates the annular electrical connection of the sheath 11M to the plate 10, around an orifice in the plate 10 through which passes a core wire 11A of the coaxial power cable 11. The core wire 11A of the coaxial cable, referred to as the signal lead wire in the general part of this description, is not directly in electrical contact with the base plate 10. The base plate 10 thus acts as an electrical ground plane during operation of the antenna 100, in emission or reception. The power cable 11 may arrive at the base plate 10 on the side facing away from the patches 1-3.

Each patch i, i being equal to 1, 2, or 3 in the example of [FIG. 1*a*] and [FIG. 1*b*], is electrically connected to the core wire 11A at a point $A_i$ of this plate i, for example at the geometric center thereof. In addition, patch i is electrically connected to the base plate 10 by at least one additional electrical connection $C_i$, which is distant from point $A_i$ on the surface of patch i. For example, the additional electrical connection $C_i$ may be located at a point on a peripheral edge of patch i. Thus, all the patches i are electrically connected in parallel between the core wire 11A on the one hand, and the sheath 11M or the base plate 10 on the other hand. Each additional electrical connection $C_i$ has been referred to as an electrical circuit closure connection in the general part of the present description. Optionally, each patch i may be provided with several additional electrical connections $C_i$. In this case, these may be in an arrangement which is symmetrical relative to the connection point $A_i$ of that patch i to the core wire 11A. In the embodiment of [FIG. 1*a*] and [FIG. 1*b*], each patch has a square shape, their centers are superimposed along direction D over the point of arrival of the coaxial cable 11 on the base plate 10, and each patch i is provided with four additional electrical connections Ci which are each located at the center of a respective side of the patch i. The additional electrical connections $C_i$ relating to different patches i are independent of one another. When several connections $C_i$ are dedicated to a same patch i, they are also independent.

Each patch i forms, with its additional electrical connections $C_i$, the base plate 10, and the signal lead wire 11A, an elementary antenna with shorted capacitive roof which has its own resonant frequency value. However, due to the proximity between all the patches i and also, to a lesser extent, due to the proximity between some of the additional electrical connections $C_i$ which are dedicated to different patches i, the resonant frequency values are modified compared to those which would be effective if the elementary antennas with shorted capacitive roof were spatially distant from each other, for identical geometric characteristics of the patches i and of the additional electrical connections $C_i$.

During operation of the antenna 100, the signal to be emitted is brought to the antenna 100 by the core wire 11A, in the form of an electrical signal. It is therefore transmitted simultaneously to all the patches i, and each elementary antenna with shorted capacitive roof emits radiation whose frequency corresponds to its resonant frequency value that is in effect within the antenna 100. This radiation also corresponds to the amplitude of the frequency component of the electrical supply signal for the same frequency value. The antenna 100 is thus multi-band, with simultaneous emissions in all its bands.

We now describe a method for manufacturing such an antenna 100, which for clarity has only two patches. These patches are denoted 1 and 2. $h_1$ (respectively $h_2$) designates again the spacing distance between patch 1 (resp. 2) and the base plate 10, and $a_1$ (resp. $a_2$) designates the diameter of patch 1 (resp. 2), the two patches here each being disc-shaped. It is assumed again that each of the patches 1, 2 is provided with four additional electrical connections $C_1$, $C_2$, located at the edge of each patch and on two perpendicular diameters thereof. The desired transmission bands for antenna 100 are the S and C bands of the Gatelink system. In other words, the desired resonant frequency values are within the 2400 MHz (megahertz)-2483.5 MHz range for one, corresponding to the S band, and within the 5150 MHz-5300 MHz range for the other, corresponding to the C band. The first resonant frequency value, in the S band, corresponds to the largest patch, i.e. patch 1, and the second resonant frequency value, in the C band, corresponds to the smallest patch, i.e. patch 2.

A first step of the method consists in determining the geometric parameters $h_1$ and $a_1$ of patch 1, such that an antenna with shorted capacitive roof which would be formed by patch 1, the base plate 10, the four electrical circuit closure connections $C_1$, and the coaxial power cable 11, in the absence of patch 2 and connections $C_2$, has a desired resonant frequency value $f_1$ in the S band, called the first resonant frequency target value in the general part of the present description. For this purpose, a starting value for the spacing distance $h_1$ can be chosen, for example equal to one-twentieth of the desired resonance wavelength, i.e. $h_1=C/(20\cdot f_1)$, where C is the speed of light. The coefficient of one-twentieth is arbitrary and can be changed. Next, the diameter or width $a_1$ can be calculated as being substantially equal to $8.749\cdot h_1$, where the coefficient 8.749 has been determined empirically such that the antenna with shorted capacitive roof has a reflection coefficient value $|S_{11}|$ which is less than −20 dB (decibel), such as less than −30 dB, for the first resonant frequency target value. This is a criterion of resonance sharpness, which is equivalent to a desired value of resonance spectral width. The value of $h_1$ can then be refined by a simulation calculation, for example a "full-wave" type of calculation known to those skilled in the art, while keeping the value of $a_1$ constant, to obtain the first resonant frequency target value $f_1$. Such a simulation calculation indicates that the resonant frequency varies as a decreasing function of the spacing distance $h_1$. Finally, the value of $a_1$ can be recalculated with the equation $a_1=8.749\cdot h_1$, using the refined value of $h_1$.

A second step of the method consists in determining the geometric parameters $h_2$ and $a_2$ of patch 2, such that an antenna with shorted capacitive roof which would be formed by patch 2, the base plate 10, the four electrical circuit closing connections $C_2$, and the coaxial power cable 11, in the absence of patch 1 and connections $C_1$, has a desired resonant frequency value $f_2$ in the C band, called the second resonant frequency target value in the general part of the present description. For this purpose, a starting value for the spacing distance $h_2$ can be chosen, for example equal to half the spacing distance $h_1$, i.e. $h_2=h_1/2$. The coefficient of one-half is arbitrary and can be changed. Next, the diameter $a_2$ can be calculated as being substantially equal to $8.749\cdot h_2$. The value of $h_2$ can then be refined by a new simulation calculation, which may again be of the "full-wave" type, while keeping the value of $a_2$ constant, to obtain the second resonant frequency target value $f_2$. As before, this simulation calculation indicates that the resonant frequency varies as a decreasing function of the spacing distance $h_2$. Finally, the value of $a_2$ can be recalculated with the equation $a_2=8.749\cdot h_2$, using the refined value of $h_2$.

When these values of $h_1$, $a_1$, $h_2$ and $a_2$ are adopted for the complete antenna 100, in other words by associating the two patches 1 and 2 and their connections $C_1$ and $C_2$ with the base plate 10, the core 11A of the coaxial cable 11 being connected to the two patches, the interactions between all these components, in particular a capacitive interaction between the two patches 1 and 2, cause the two resonant frequency values to change. They thus respectively become $f_1'$, different from $f_1$, and $f_2'$, different from $f_2$.

The third step of the method is to adjust the values of $h_1$, $a_1$, $h_2$ and $a_2$ so that the quotient of the values $f_2'/f_1'$ becomes substantially equal to the quotient $f_2/f_1$ of the resonant frequency target values. Simulations, for example also of the "full-wave" type, show that the value of the quotient $f_2'/f_1'$ varies increasingly as a function of $h_2$, and also increasingly as a function of $a_2$ but with a lower rate of variation. At the same time, the value $f_1'$ varies decreasingly as a function of $h_2$ and also of $a_2$, while the value $f_2'$ varies increasingly as a function of $h_2$ and decreasingly as a function of $a_2$.

Finally, a fourth step of the method consists in applying a same scale factor to the four values of $h_1$, $a_1$, $h_2$ and $a_2$ as resulting from the third step, in order to return the value $f_1'$ to the first target value $f_1$. The scale factor to apply is the value of the quotient $f_1'/f_1$. This step in fact consists in applying a proportional transformation to the antenna 100 that resulted from the third step, to obtain the first target value $f_1$ of resonant frequency ($f_1'=f_1$). It does not change the value of quotient $f_2'/f_1'$, so the second resonant frequency target value $f_2$ is obtained simultaneously ($f_2'=f_2$).

Thus, to obtain $f_1$=2441.75 MHz and $f_2$=5225 MHz, the method just described has provided the following values to be adopted for the dual-band antenna 100: $a_1$=54.94 mm (millimeters), $h_1$=6.05 mm, $a_2$=43.93 mm, and $h_2$=3.78 mm. To this end, the cross-sectional diameter of the core 11A of the coaxial power cable 11 was taken as equal to 1.27 mm, and each electrical circuit closure connection $C_1$, $C_2$ was taken as being a column having a square cross-section with 0.53 mm sides. The dual-band antenna 100 thus obtained has a footprint of approximately 55 mm×55 mm×6 mm. It can therefore be easily placed on the fuselage of an airplane, without significantly modifying its airflow properties.

Figure 3:
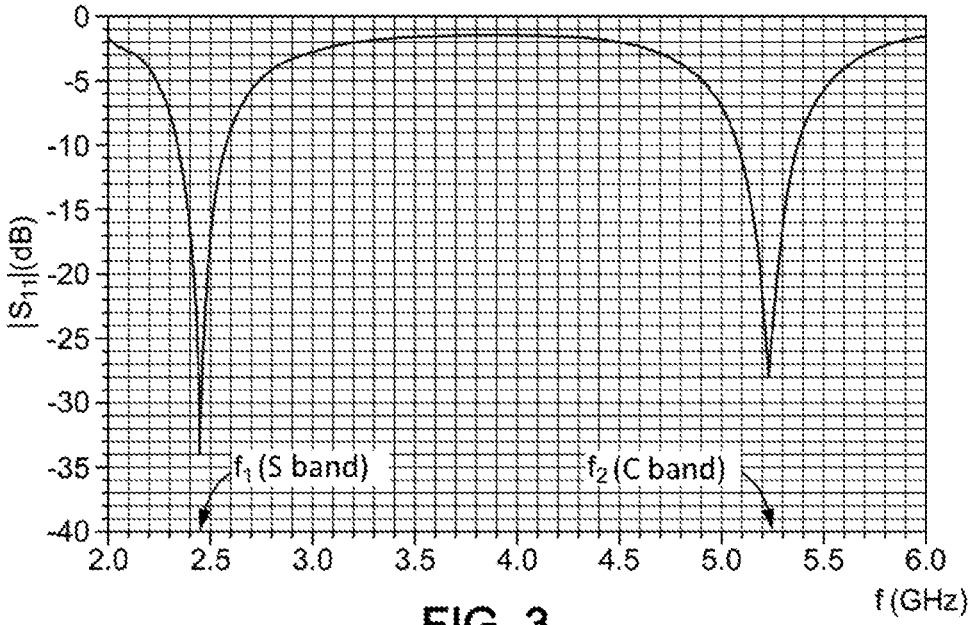
FIG. 3 shows variations of a reflection coefficient of the multi-band antenna, as a function of a signal frequency.

The diagram of [FIG. 3] shows the spectral variations of the reflection coefficient $|S_{11}|$ of the dual-band antenna 100 thus obtained. The horizontal axis identifies the frequency values fin gigahertz (GHz), and the vertical axis identifies the values of $|S_{11}|$ expressed in dB. The two resonances for the signal frequency values of 2.44175 GHz ($f_1$ in S-band) and 5.225 GHz ($f_2$ in C-band) are clearly visible.

Figure 4:
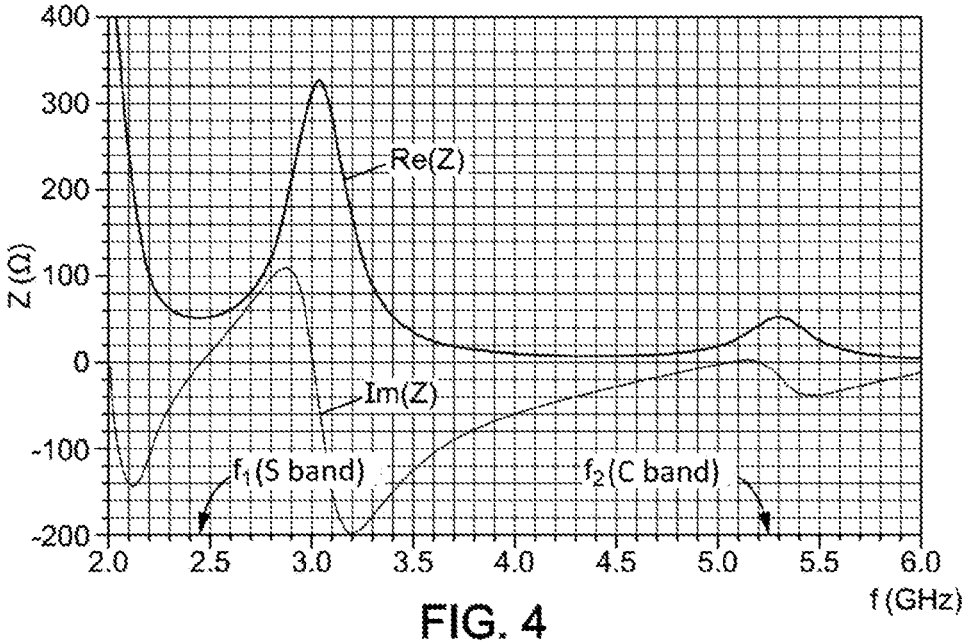
FIG. 4 shows variations of an input impedance of the multi-band antenna.

The diagram of [FIG. 4] shows the spectral variations of the input impedance Z of the same dual-band antenna 100, as this input impedance appears between the core 11A and the sheath 11M of the coaxial power cable 11. The two curves respectively correspond to the real part of the impedance Z, denoted Re(Z), and the imaginary part of the impedance Z, denoted Im(Z). The two resonances substantially correspond to the values of the frequency f for which the imaginary part of the impedance Z cancels out. For these two values, $f_1$ and $f_2$, the real part of the Z impedance is roughly equal to 50Ω (ohm).

Figure 5A:
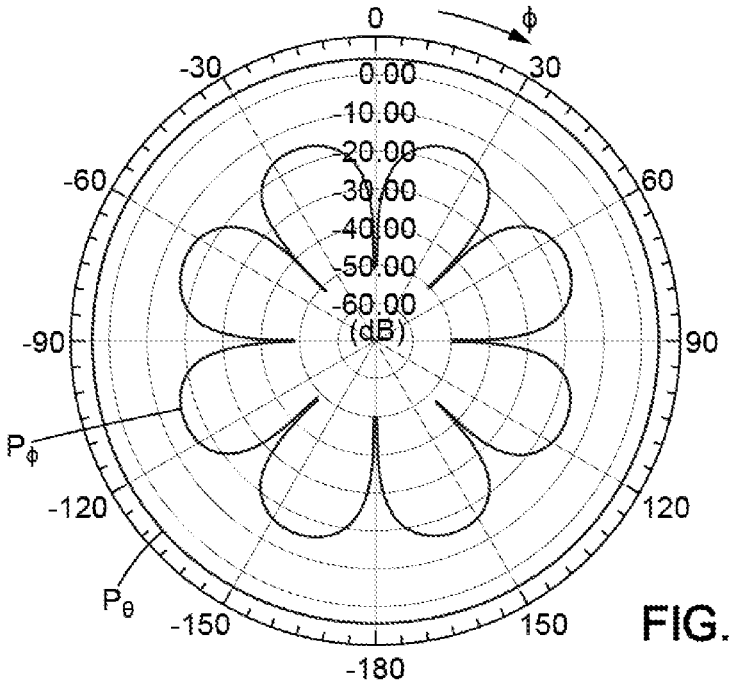
FIGS. 5*a* and 5*b* illustrate radiation patterns of the multi-band antenna for a fixed elevation value and for two distinct resonant frequencies of this antenna.

The radiation pattern of the same dual-band antenna 100 for the emission frequency value $f=f_1=2441.75$ MHz, in the S band, is reproduced in [FIG. 5*a*]. The angle $\phi$ is again the azimuth angle around the direction of superposition D of the patches 1-2, as shown in [FIG. 1*a*]. The considered value of the elevation angle $\theta$ in each meridian plane which contains the direction D, is equal to 45° (degrees). The concentric circles correspond to the power value of the radiation emitted by the antenna 100 in each direction ($\phi$ between −180° and +180°, $\theta$=45°), expressed in decibels between 0 dB and −60 dB. The curve which is indicated by $P_\theta$ corresponds to the radiation emitted at frequency $f_1$ by the antenna 100 with a polarization which is parallel to unit vector $u_\theta$ as introduced with reference to [FIG. 1*a*], and the curve which is indicated by $P_\phi$ corresponds to the radiation emitted at frequency $f_1$ by the antenna 100 with a polarization which is parallel to unit vector $u_\phi$. The comparison of both curves $P_\theta$ and $P_\phi$ shows that the emitted radiation is essentially polarized parallel to vector $u_\theta$.

Figure 5B:
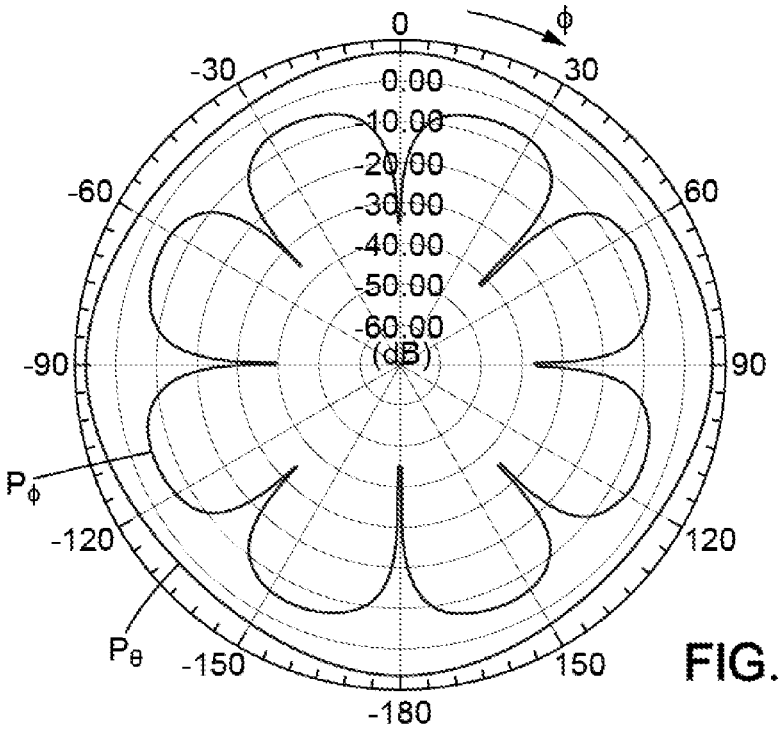

[FIG. 5*b*] is a radiation pattern similar to that of [FIG. 5*a*], but for the emission frequency value $f=f_2=5225$ MHz, in the C band.

Figure 6A:
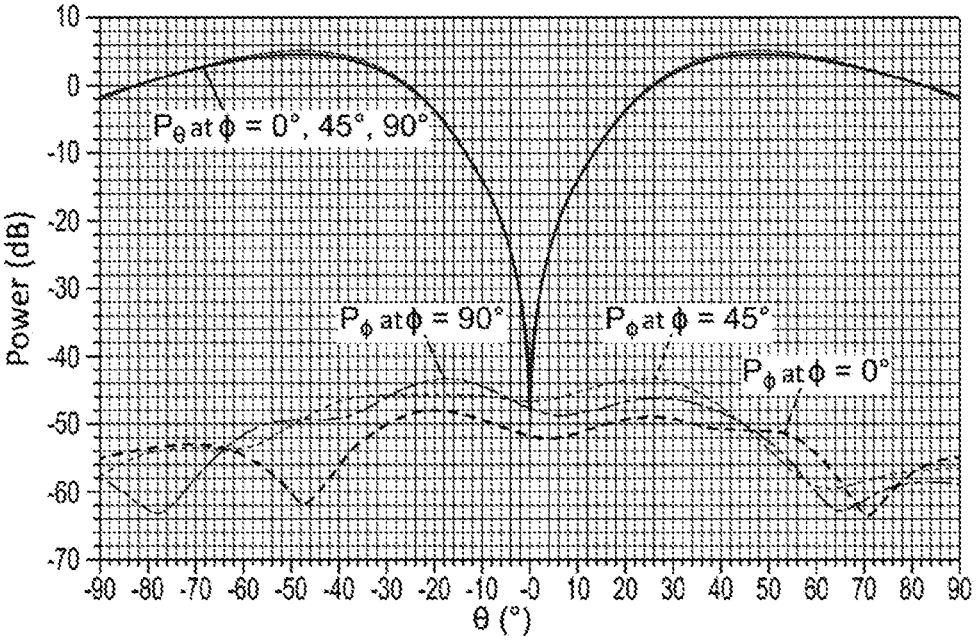
FIGS. 6*a* and 6*b* illustrate two other radiation patterns of the multi-band antenna, within several meridian planes and for the two resonant frequencies.

The radiation pattern of [FIG. 6*a*] shows the angular distributions, as a function of the elevation angle $\theta$, of the power emitted by the antenna 100 at frequency $f_1$ inside the meridian planes which correspond to the following values of the azimuth angle: $\phi$=0°, $\phi$=45°, and $\phi$=90°, for the two polarizations of the radiation respectively parallel to unit vector $u_\phi$ (curves denoted by $P_\phi$) and parallel to unit vector $u_\theta$ (curves denoted by $P_\theta$). These curves show that the power of the emitted radiation is substantially zero along direction D, and that it is only significant for the polarization parallel to unit vector $u_\theta$ and the values of the elevation angle $\theta$ which are between 25° and 90° ($P_\theta$ curves). Indeed, and in a manner consistent with [FIG. 5*a*], the power of the emitted radiation which has the polarization parallel to unit vector $u_\phi$ is very low for all values of the azimuth angle $\phi$. For reception points M which are located substantially at the base plate 10, in other words the values of the elevation angle $\theta$ which are close to 90°, the radiation emitted by the antenna 100 at frequency $f_1$, in the S band, is therefore essentially polarized perpendicularly to this base plate.

Figure 6B:
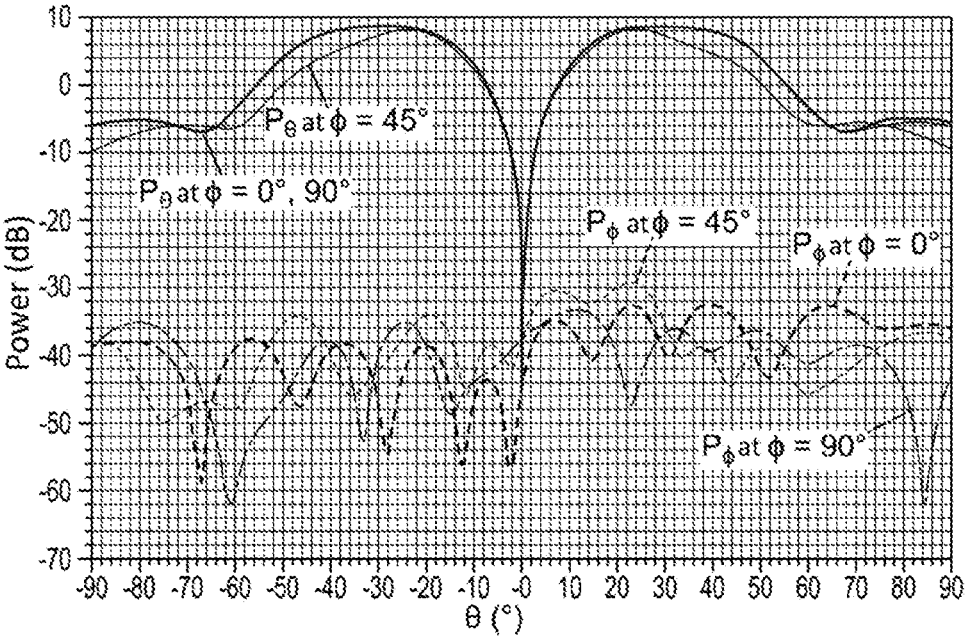

[FIG. 6*b*] is a radiation pattern similar to that of [FIG. 6*a*], but for the emission frequency value $f_2$, in the C band. The power of the emitted radiation is still substantially zero along direction D, and again is only significant for the polarization which is parallel to unit vector $u_\theta$ and the values of the elevation angle $\theta$ which are between 15° and 90° ($P_\theta$ curves). Similarly to frequency $f_1$, the radiation which is emitted by the antenna 100 at frequency $f_2$, in the C band, is essentially polarized perpendicularly to the base plate 10 for reception points M which are located substantially at this base plate.

The curves of the patterns of [FIG. 5*a*], [FIG. 5*b*], [FIG. 6*a*], and [FIG. 6*b*] show that the radiation emissions from antenna 100 in both the S and C bands are very suitable for Gatelink system applications.

It is understood that the invention may be reproduced by modifying secondary aspects of the embodiments described in detail above, while retaining at least some of the cited advantages. In particular, the number of patches may be changed, the electrical circuit closure connections are not necessarily located on the edges of the patches, the number of electrical circuit closure connections per patch may be changed, and the patches are not necessarily square or disc-shaped. In addition, all the given numerical values were for illustration only, and may be changed according to the application considered.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A multi-band antenna comprising:

a metal base plate configured as an electrical ground plane; and a plurality of metal patches each parallel to the metal base plate and which are each arranged at a different respective distance from the metal base plate, wherein the metal patches are each electrically connected to a common signal lead wire, wherein each metal patch is connected to the metal base plate, independently of the other metal patches, by at least one electrical circuit closure connection dedicated to the metal patch, wherein the metal patches are connected in parallel between the common signal lead wire and the metal base plate, and wherein the respective distances and respective surface area values of each of the metal patches are configured such that each of the metal patches with the respective said at least one electrical circuit closure connection dedicated to the metal patch forms a radiating element having at least one resonant frequency value different from resonant frequency values of the other radiating elements.

2. The multi-band antenna of claim 1, wherein the metal patches are superimposed in a direction of superposition is perpendicular to the metal base plate, and each of the metal patches has a surface area value different from the surface area value of the other metal patches, and the surface area vale of the metal patches increases from one of the metal patches to an neighboring one of the metal patches as a function of the respective distances of the metal patches from the metal base plate.

3. The multi-band antenna of claim 1, wherein a plurality of the electrical circuit closure connections are dedicated to one of the metal patches, and the plurality of the electrical circuit closure connections are in an arrangement which is symmetrical relative to a connection point of said metal patch to the common signal lead wire.

4. The multi-band antenna of claim 1, wherein each of the plurality of electrical circuit closure connections dedicated to one of the metal patches is connected to a peripheral edge of the one of the metal patches.

5. The multi-band antenna of claim 1, wherein each of the metal patches is connected to the metal base plate by two or four of the electrical circuit closure connections.

6. An aircraft comprising the multi-band antenna of claim 1, wherein the multi-band antenna is attached to a fuselage of the aircraft.

7. A method for manufacturing the multi-band antenna of claim 1 comprising:

(a) for the one of the metal patches which is farthest from the metal base plate, referred to as the first metal patch, determining a surface area value of said first metal patch and a spacing distance value between said first metal patch and the metal base plate such that a first elementary antenna, of shorted capacitive roof type, which is formed by the first metal patch with the at least one electrical circuit closure connection dedicated to said first metal patch, and with the metal base plate and the signal lead wire, has a first resonant frequency target value and a first spectral width of resonance;

(b) for a second of the metal patches, which comes after the first metal patch when approaching the metal base plate, setting a spacing distance between the second metal patch and the metal base plate to a value which is less than that of the spacing distance between said first metal patch and the metal base plate, then determining a surface area value of said second metal patch such that a second elementary antenna, of shorted capacitive roof type, which is formed by the second metal patch with the at least one electrical circuit closure connection dedicated to said second metal patch, and with the metal base plate and the signal lead wire, has a second resonant frequency target value and a second spectral width of resonance;

(c) adjusting the value of the spacing distance between the second metal patch and the metal base plate, and the surface area value of said second metal patch, so that a quotient of first and second resonant frequency values which are effective when the first and second metal patches are associated together with the metal base plate by the signal lead wire shared by said first and second metal patches, and with the respective electrical circuit closure connections of said first and second metal patches, matches a quotient target value which is equal to the quotient of the second resonant frequency target value over the first resonant frequency target value; and (d) applying a common scale factor to the respective spacing distance values of the first and second metal patches relative to the metal base plate, and to the dimensions of said first and second metal patches which produce the respective surface area values of said patches, so that the first resonant frequency value which is effective when the first and second metal patches are associated together with the metal base plate by the signal lead wire shared by said first and second metal patches, and with the respective electrical circuit closure connections of said first and second metal patches, matches the first resonant frequency target value, wherein the sequence of steps (a) to (d) are repeated for each pair of neighboring ones of the metal patches by shifting by one of the metal patches in the direction of the metal base plate between two repetitions of the sequence of steps, and the method further comprises manufacturing the multi-band antenna in accordance with the values obtained for the spacing distance of each metal patch from the metal base plate, and for the surface area of each metal patch.

8. The method of claim 7, wherein the first resonant frequency target value is less than the second resonant frequency target value.

9. The method of claim 7, wherein each of the metal patches is in a metallized surface of a respective printed circuit board substrate, and segments of the electrical circuit closure connections are formed through at least some of the printed circuit board substrates, then the printed circuit board substrates are stacked on the metal base plate so as to establish electrical contact between all segments of a same electrical circuit closure connection, separately for each of the electrical circuit closure connections.

10. The method of claim 7, wherein each of the metal patches is a separate metal plate portion, then each of the separate metal plate portions forming one of the metal patches is assembled with the metal base plate using spacers, the electrical circuit closure connections possibly forming said spacers.

11. A method for manufacturing a multi-band antenna including a metal base plate and first and second metal patches both parallel to the metal base plate, wherein the first and second metal patches are connected to the metal base plate by a common signal lead wire, the first metal patch, but not the second metal patch, is connected to the metal base plate by a first electrical circuit closure connection, and the second metal patch, but not the first metal patch, is connected to the metal base plate by a second electrical circuit closure connection connecting, wherein the method comprises:

for a first antenna, determine a surface area value of the first metal patch and a relative spacing distance value of a distance between the first metal patch and the metal base plate which achieves a first resonant frequency target value and a first spectral width of resonance for the first antenna;

for a second antenna, setting a relative spacing distance value for a distance between the second metal patch and the metal base plate to a distance less than the spacing distance between the first metal patch and the metal base plate and determining a surface area value of the second metal patch to achieve a second resonant frequency target value and a second spectral width of resonance for the second antenna;

adjusting the value of the spacing distance between the second metal patch and the metal base plate and/or the surface area value of said second metal patch to achieve a match between a ratio of the first and second resonant frequency target values and a quotient target value equal to a ratio of the first and second resonant frequency target values; and applying a common scale factor to the respective spacing distance values of the first and second metal patches and/or to dimensions of said first and second metal patches to adjust the first resonant frequency value to match the first resonant frequency target value.

12. The method of claim 11, wherein the first resonant frequency target value is less than the second resonant frequency target value.

13. The method of claim 11, wherein the method is repeated for pairs of neighboring metal patches in the multi-band antenna.

14. The method of claim 13, wherein after the method is completed for a first of the pairs of neighboring metal matches the method is repeated for another of the pairs of the neighboring metal patches which includes one of the metal patches in the first pair.

15. The method of claim 11, further comprising manufacturing the multi-band antenna to have the relative spacing distance values and surface area values for the first and second metal patches.

16. The method of claim 15, wherein each of the metal patches is formed in a metallized surface of a respective printed circuit board substrate, and segments of the electrical circuit closure connections are formed through at least some of the printed circuit board substrates.

17. The method of claim 15, wherein each of the metal patches is formed as a separate metal plate portion, and each of the separate metal plate portions are assembled with the metal base plate using as spacers between the metal plate portions.

18. The method of claim 11 wherein the first and second antennas are each a shorted capacitive roof antenna.

* * * * *